US005699078A

United States Patent [19]

Yamazaki et al.

[11] Patent Number: 5,699,078

[45] Date of Patent: Dec. 16, 1997

[54] ELECTRO-OPTICAL DEVICE AND METHOD OF DRIVING THE SAME TO COMPENSATE FOR VARIATIONS IN ELECTRICAL CHARACTERISTICS OF PIXELS OF THE DEVICE AND/OR TO PROVIDE ACCURATE GRADATION CONTROL

[75] Inventors: Shunpei Yamazaki, Tokyo; Masaaki Hiroki, Kanagawa; Yasuhiko Takemura, Kanagawa; Eiji Sato, Kanagawa, all of Japan

[73] Assignee: Semiconductor Energy Laboratory Co., Ltd., Kanagawa, Japan

[21] Appl. No.: 916,620

[22] Filed: Jul. 22, 1992

[30] Foreign Application Priority Data

Jul. 27, 1991 [JP] Japan ..... 3-209870

[51] Int. Cl.[6] ..... G09G 3/36; G09G 5/10

[52] U.S. Cl. ..... 345/147; 345/89

[58] Field of Search ..... 340/765, 781, 340/784, 793, 812; 345/63, 77, 89, 95, 147, 199

[56] References Cited

U.S. PATENT DOCUMENTS

| | | | |
|---|---|---|---|
| 4,755,724 | 7/1988 | Wagner | 340/752 |
| 4,801,933 | 1/1989 | Yamamoto et al. | 340/784 |
| 4,897,639 | 1/1990 | Kanayama | 340/812 |
| 5,128,782 | 7/1992 | Wood | 345/102 |

FOREIGN PATENT DOCUMENTS 2-144591 6/1990 Japan .

*Primary Examiner*—Jeffery Brier

*Attorney, Agent, or Firm*—Sixbey, Friedman, Leedom & Ferguson, P.C.; Gerald J. Ferguson, Jr.

[57] ABSTRACT

An electro-optical device system capable of displaying fine gradation, which includes an electro-optical device equipped with an active matrix, a memory device in which information on the characteristics of the pixels are stored, a device for converting an analog image signal into a digital image signal, and a processor which corrects the digital signals in accordance with the information stored in the memory device.

20 Claims, 13 Drawing Sheets

| | | | | | | | |
|---|---|---|---|---|---|---|---|
| 0 | 10 | 20 | 30 | 40 | 50 | 60 | 70 |
| 80 | 90 | 100 | 0 | 10 | 20 | 30 | 40 |
| 100 | 100 | 0 | 0 | 100 | 100 | 0 | 0 |
| 100 | 100 | 0 | 0 | 100 | 100 | 0 | 0 |
| 0 | 0 | 100 | 100 | 0 | 0 | 100 | 100 |
| 0 | 0 | 100 | 100 | 0 | 0 | 100 | 100 |
| 0 | 10 | 20 | 30 | 40 | 50 | 60 | 70 |
| 80 | 90 | 100 | 0 | 10 | 20 | 30 | 40 |

| | | | | | | | |
|---|---|---|---|---|---|---|---|
| 100 | 100 | 100 | 100 | 100 | 100 | 100 | 100 |
| 100 | 100 | 100 | 100 | 100 | 100 | 100 | 100 |
| 90 | 90 | 90 | 90 | 90 | 90 | 90 | 90 |
| 80 | 80 | 80 | 80 | 80 | 80 | 80 | 80 |
| 70 | 70 | 70 | 70 | 70 | 70 | 70 | 70 |
| 60 | 60 | 60 | 60 | 60 | 60 | 60 | 60 |
| 50 | 50 | 50 | 50 | 50 | 50 | 50 | 50 |
| 50 | 50 | 50 | 50 | 50 | 50 | 50 | 50 |

| | | | | | | | |
|---|---|---|---|---|---|---|---|
| 0 | 10 | 20 | 30 | 40 | 50 | 60 | 70 |
| 80 | 90 | 100 | 0 | 10 | 20 | 30 | 40 |
| 90 | 90 | 0 | 0 | 90 | 90 | 0 | 0 |
| 80 | 80 | 0 | 0 | 80 | 80 | 0 | 0 |
| 0 | 0 | 70 | 70 | 0 | 0 | 70 | 70 |
| 0 | 0 | 60 | 60 | 0 | 0 | 60 | 60 |
| 0 | 5 | 10 | 15 | 20 | 25 | 30 | 35 |
| 40 | 45 | 50 | 0 | 5 | 10 | 15 | 20 |

FIG.7A "1"
FIG.7B "2"
FIG.7C "3"
FIG.7D "4"
FIG.7E "5"
FIG.7F "6"
FIG.7G "7"
FIG.7H "8"
FIG.7I "9"
FIG.7J "10"
FIG.7K "11"
FIG.7L "12"
FIG.7M "13"
FIG.7N "14"
FIG.7O "15"
TIME

FIG.8A "1"
FIG.8B "2"
FIG.8C "3"
FIG.8D "4"
FIG.8E "5"
FIG.8F "6"
FIG.8G "7"
FIG.8H "8"
FIG.8I "9"
FIG.8J "10"
FIG.8K "11"
FIG.8L "12"
FIG.8M "13"
FIG.8N "14"
FIG.8O "15"
TIME $Z_{n,m}$ : $T_1 + 2T_1 = 3T_1 \longrightarrow$ "3"
$Z_{n+1,m}$ : $4T_1 \longrightarrow$ "4"
$Z_{n,m+1}$ : $4T_1 + 2T = 6T_1 \longrightarrow$ "6"
$Z_{n+1,m+1}$ : $T_1 + 4T_1 = 5T_1 \longrightarrow$ "5"

ELECTRO-OPTICAL DEVICE AND METHOD OF DRIVING THE SAME TO COMPENSATE FOR VARIATIONS IN ELECTRICAL CHARACTERISTICS OF PIXELS OF THE DEVICE AND/OR TO PROVIDE ACCURATE GRADATION CONTROL

BACKGROUND OF THE INVENTION

1. Field of the Invention

The present invention relates to an electro-optical device using thin film transistors (referred to hereinafter as TFTs) as the switching elements. More particularly, it relates to a display device capable of displaying images with favorable intermediate color tone and brightness.

2. Prior Art

A liquid crystal composition has, by nature, difference in permittivity along the vertical and the horizontal direction with respect to the direction of the molecular axis of the constituting molecules. That is, the molecules of a liquid crystal composition can be readily arranged either parallel to the direction of the external electric field or along a direction vertical thereto upon application of an external electric field to the composition. A liquid crystal electro-optical device takes advantage of this anisotropy in permittivity to control the amount of the transmitted light or of the scattered light to display the ONs and OFFs, i.e., the light and the dark states of the display. Liquid crystal materials known heretofore include a TN (twisted nematic) liquid crystal, an STN (super-twisted nematic) liquid crystal, a ferroelectric liquid crystal, an antiferroelectric liquid crystal, a polymer liquid crystal, and a dispersion type liquid crystal.

Among the electro-optical devices using a liquid crystal, those equipped with active matrices yield images of best quality. A conventional electro-optical device driven by an active matrix system comprises TFTs as the active elements. The TFTs which are attached to each of the pixels may be either P-type or N-type, and they are based on an amorphous semiconductor or a polycrystalline semiconductor. In general, the N-channel type TFTs (referred to hereinafter as NTFTs) are serial connected to the pixels. The signal voltage is applied to each of the signal lines constituting the matrix. Since the TFTs are provided at the crossings of the signal lines, each of the TFTs can be supplied with signals from two lines. Thus, each of the TFTs control the ONs and OFFs of the corresponding pixel by turning ON the liquid crystal pixel only when the signals are applied to the TFT from both signal lines. A liquid crystal electro-optical device having a large contrast can be achieved in this way by controlling each of the pixels.

However, even with the liquid crystal device driven by such an active matrix system, it still is extremely difficult to provide a gradation display with which brightness and darkness or color tones are satisfactorily expressed. Such a gradation in image has been expressed conventionally by a system in which the light transmittance is varied in accordance with the applied voltage. More specifically, a gradation display is realized in such a system by providing a pertinent voltage between the source and the drain within the matrix, and while maintaining this state, applying a signal voltage to the gate to thereby apply the corresponding voltage to the liquid crystal pixel.

However, the system above suffers disadvantages such as those ascribed to the inhomogeneity in both the TFTs and the matrix wirings. In fact, the voltage which is applied to a liquid crystal pixel differs from one to another by at least several percent, and in general, the difference amounts to several tens of percent. A fluctuation in the applied voltage of a mere several percent sometimes causes a sudden change in the light transmittance, because there is a distinct non-linear relationship between the light transmittance of a liquid crystal and the applied voltage. Accordingly, a 16 gradation is the practically achievable limit with a system of the type above. In a TN liquid crystal material, for example, the so-called transition region in which the light transmittance changes from an ON state to an OFF state accounts for a width of 1.2 V. Thus, if a 16 gradation were to be achieved, the voltage must be precisely controlled to a value as small as one-sixteenth of a voltage range of 1.2 V, i.e., 75 mV. This requirement extremely lowers the product yield. The fact that a liquid crystal display device has a difficulty in achieving a gradation in display makes it considerably less competitive as compared with a conventional cathode ray tube (CRT).

SUMMARY OF THE INVENTION

In the light of the circumstances above, an object of the present invention is to provide a novel electro-optical device capable of realizing a display having gradation in image. The liquid crystal device according to the present invention is characterized by that it comprises having assembled therein a memory device having memorized beforehand the characteristics of each of the pixels, and that each of said pixels is driven in accordance with a pertinent image signal having obtained by correcting in an arithmetic unit the input image signal with said information (data) on the pixel characteristics having stored in the memory device. For instance, suppose that pixel A provides an output of 100 in correspondence to an input of 50, and that pixel B requires an input of 150 to yield an output of 100. If, for example, the same input of 100 were to be provided to both of the pixels A and B, it results in an output of 200 in the case of pixel A and an output of 70 for pixel B. In general, since no correction in accordance with the characteristics of the pixels is made to each of the projected image signals provided to the display device, an extremely uneven image results due to the fluctuation of the pixel characteristics even though an image having a uniform brightness is desired. In contrast, the present invention provides a display device reduced in image unevenness, by providing input signals having corrected for each of the pixels. For example, the input image signal is multiplied by digital amendment data which are dependent on addresses of pixels in order to compensate for dispersion (fluctuation) of electric characteristics of the pixels, and the products of the input image signal and the digital amendment data are sent to the pixels to drive the pixels.

However, in a system provided with analog image signals similar to the conventional signals, it is quite difficult to make corrections for each of the pixels. Even if those corrections should be made, still, they are very low in precision. Let us consider a case of a pixel having an optimal voltage at 92% of the applied voltage. When an input signal of 2.52 V is applied, the precision depends on the error of the characteristics of the processing circuit. Thus, the voltage actually applied to the pixel fluctuates in a wide range of from 2.2 V to 2.4 V. Thus, it is impossible to display fine gradation such as the aforementioned 16 step gradation.

In view to overcome the aforementioned problems, the present invention proposes an electro-optical device capable of providing images having excellent intermediate gradation, and a method of driving such an electro-optical device for providing such images. In the device according to the present invention, an analog image signal is converted into a digital image signal, and after correcting the resulting digital signal in accordance with the characteristics of the respective pixels, the corrected digital signal is applied to the corresponding pixel. In the device, the characteristics of the individual pixels are stored beforehand in a memory device as digitized numerals which are dependent on addresses of pixels, and the memorized characteristics are processed together with the digital image signal to obtain a corrected digital signal. A similar effect can be obtained by storing each of the gradation data for each of the pixels, and then reading out the appropriate signal from the memory device by specifying the particular pixel and gradation. That is, a storage region in a memory is accessed in accordance with an address and an information of an original data, and digital data stored in the accessed storage region is sent to a pixel in accordance with said address to drive said pixel wherein said digital data are dependent on addresses of pixels and the information of said original data. The original data has an information of gradation level. In this case again, the data in the memory device are digital numerals. By thus carrying out the processing with digital numerals, a high quality image with less unevenness can be obtained.

DESCRIPTION OF THE PRESENT INVENTION

Figure 1:
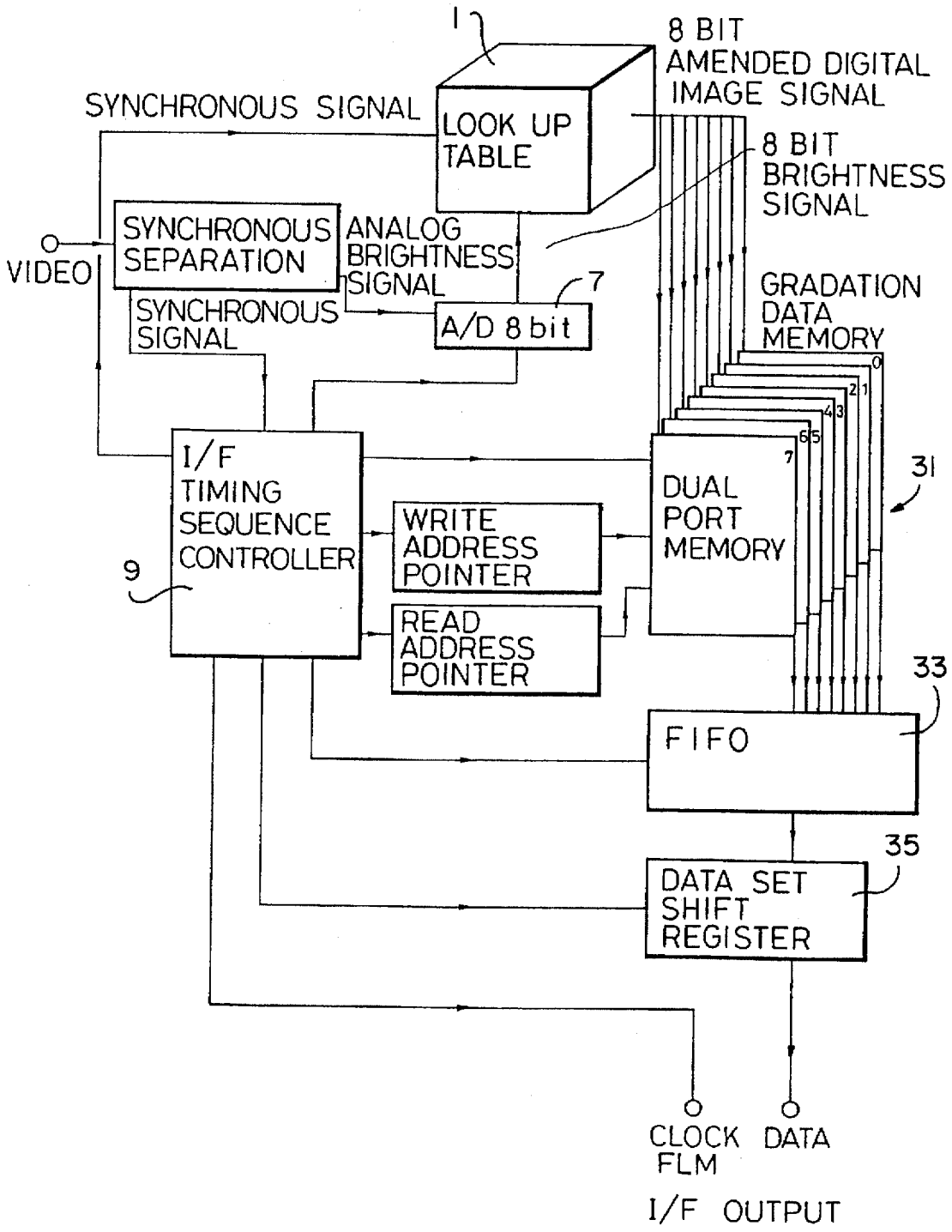
FIG. 1 shows an example of a block diagram for an image signal processing device according to an embodiment of the present invention.
Figure 2:
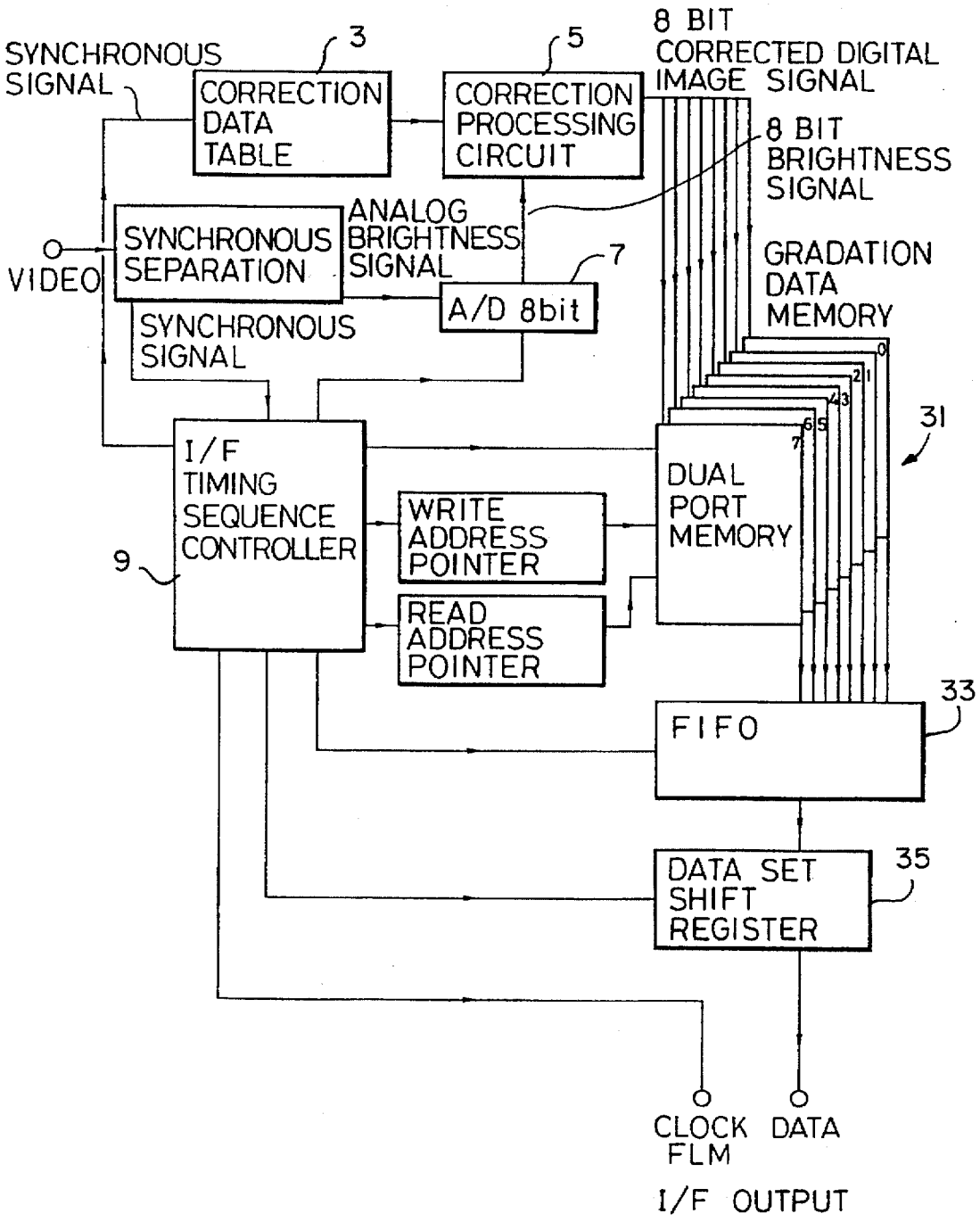
FIG. 2 shows another example of a block diagram for an image signal processing device according to an embodiment of the present invention.

Referring to FIGS. 1 and 2, examples of display devices according to the present invention are described below. It can be seen that the display device according to the present invention comprises a look-up table 1 (FIG. 1) or a correction data table 3 and a correction processing circuit 5 (FIG. 2).

Figure 6:
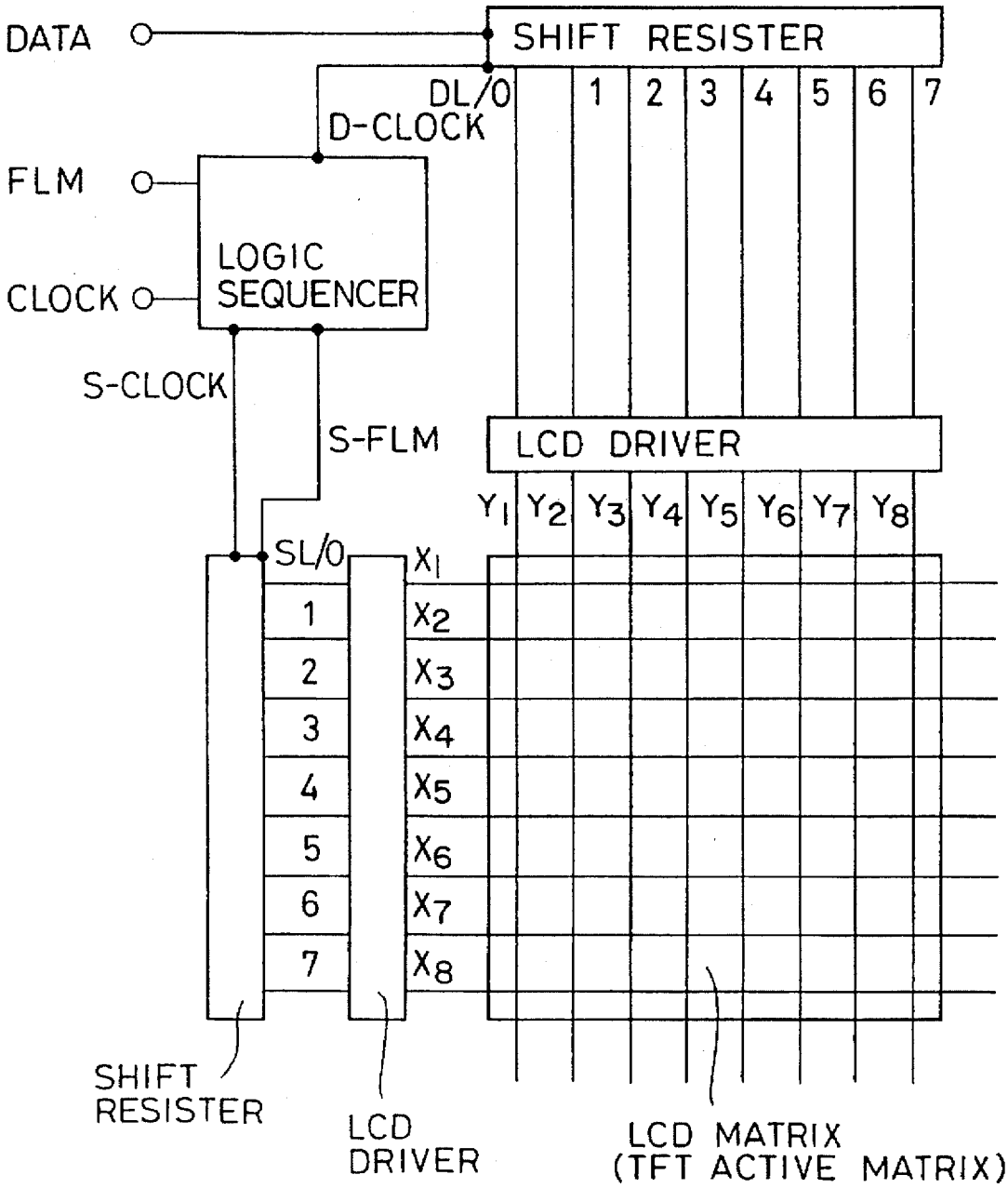
FIG. 6 shows schematically an image display device according to the present invention and peripheral circuits thereof.

As shown in FIGS. 1 and 2, an analog image signal is separated into a synchronizing signal and an analog brightness signal which is then input into an analog-digital converter 7 (indicated with "A/D 8 bit" in the figure) to obtain, e. g., a 8-bit digital signal. The digital signal thus obtained contains information on brightness (gradient). The synchronizing signal, on the other hand, includes information on the position (address) of the pixels, and is then transferred to a sequence controller 9 and further distributed to various devices such as a look-up table 1, a correction data table 3, and a correction processing circuit. In a construction as shown in FIG. 1, an output signal for the corresponding pixel at a corresponding brightness is drawn from the look-up table in accordance with the digital brightness signal and the synchronizing signal. The output signal thus drawn out from the look-up table is then transferred to the next step. In a construction as shown in FIG. 2, on the other hand, the digital brightness signal is introduced to the correction processing circuit. At this point, the information on the characteristics of the pixel corresponding to the digital brightness signal is transferred from the correction data table to the correction processing circuit by the synchronizing signal to correct the digital brightness signal. The corrected digital brightness signal thus obtained is output for the next step and then transferred finally to the display image plane via a circuit as shown in FIG. 6.

Figure 3:
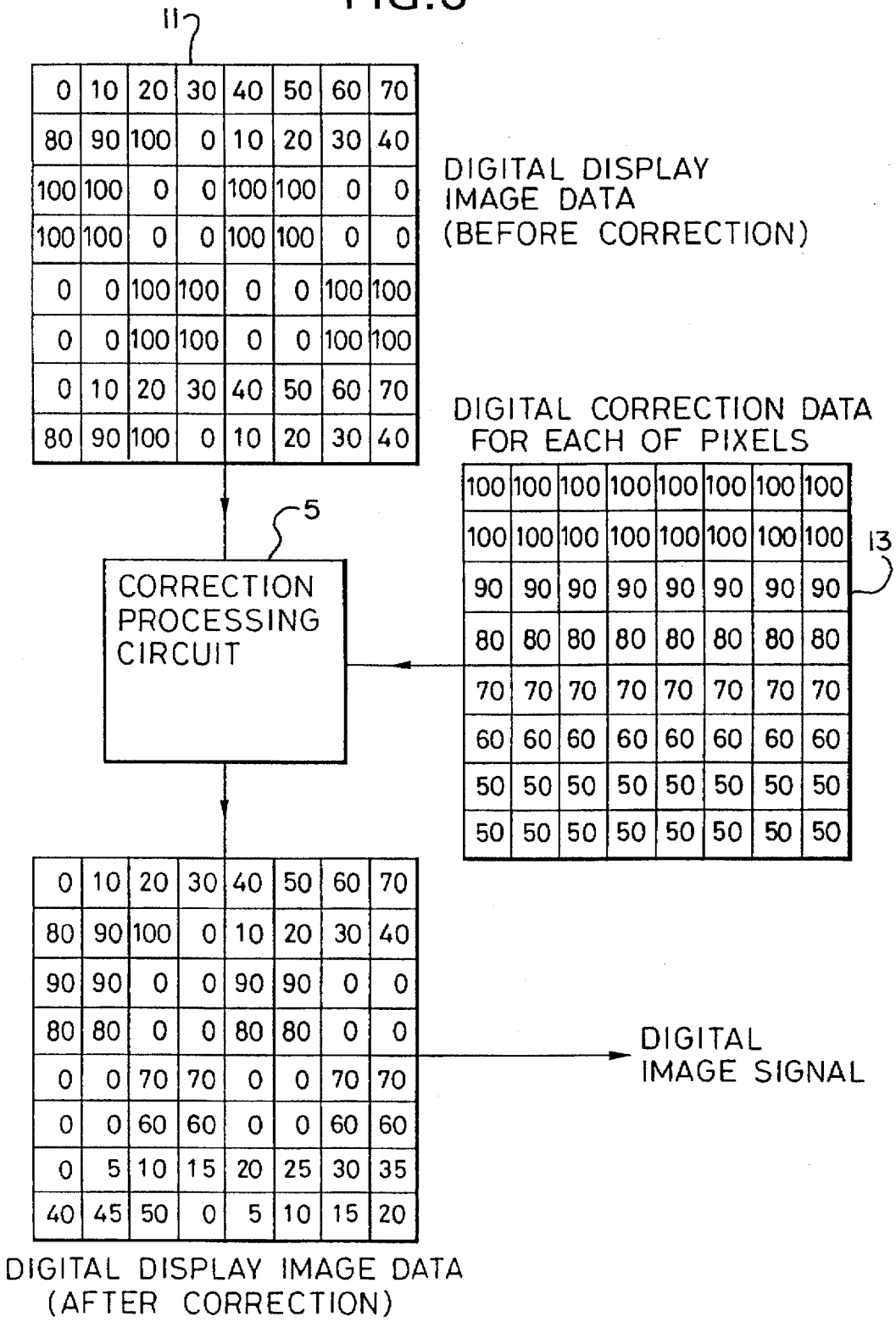
FIG. 3 shows an example of correcting an image data according to the present invention.

Referring to FIG. 3, the method of correcting the data as mentioned in FIG. 2 is described in further detail. As shown in the figure, the display image data 11 having digitized and the correction data 13 for each of the pixels are simultaneously introduced to the correction processing circuit 5. The correction data are drawn from the correction data table, and each of the data requires e.g., a memory size of 8 bit for a 256-gradation. In this example, a small memory of 8×8×8=512 bit works sufficiently because the image size under consideration is such of a small 8×8 matrix. Even in the case of a larger matrix, i.e., such as those of 640×480 dots, however, a memory of 4 megabit is enough. Suitable as the memories for the correction table include random access memories (RAMs) such as DRAM and SRAM, as well as non-volatile memories such as EPROM, EEPROM, and flash memories.

For example, the pixel located at the fourth line in the second column is known by a previous measurement that it yields an output of 100 for an input of 80. Thus, information of 80 is stored in the correction data table. In the correction processing circuit, the input signal 100 is multiplied by 0.8 (80%) to obtain a signal of 80, and the resulting signal is then input into the pixel via a circuit as shown in FIG. 6.

Similarly, in the pixel at the seventh line in the seventh column provides an output of 100 at an input of mere 50. Thus, by introducing an input signal 60, an output signal of 30 is obtained and input to the pixel. In this manner, the signals to be input into the pixels are corrected based on the respective correction data provided for each of the pixels.

Figure 4:
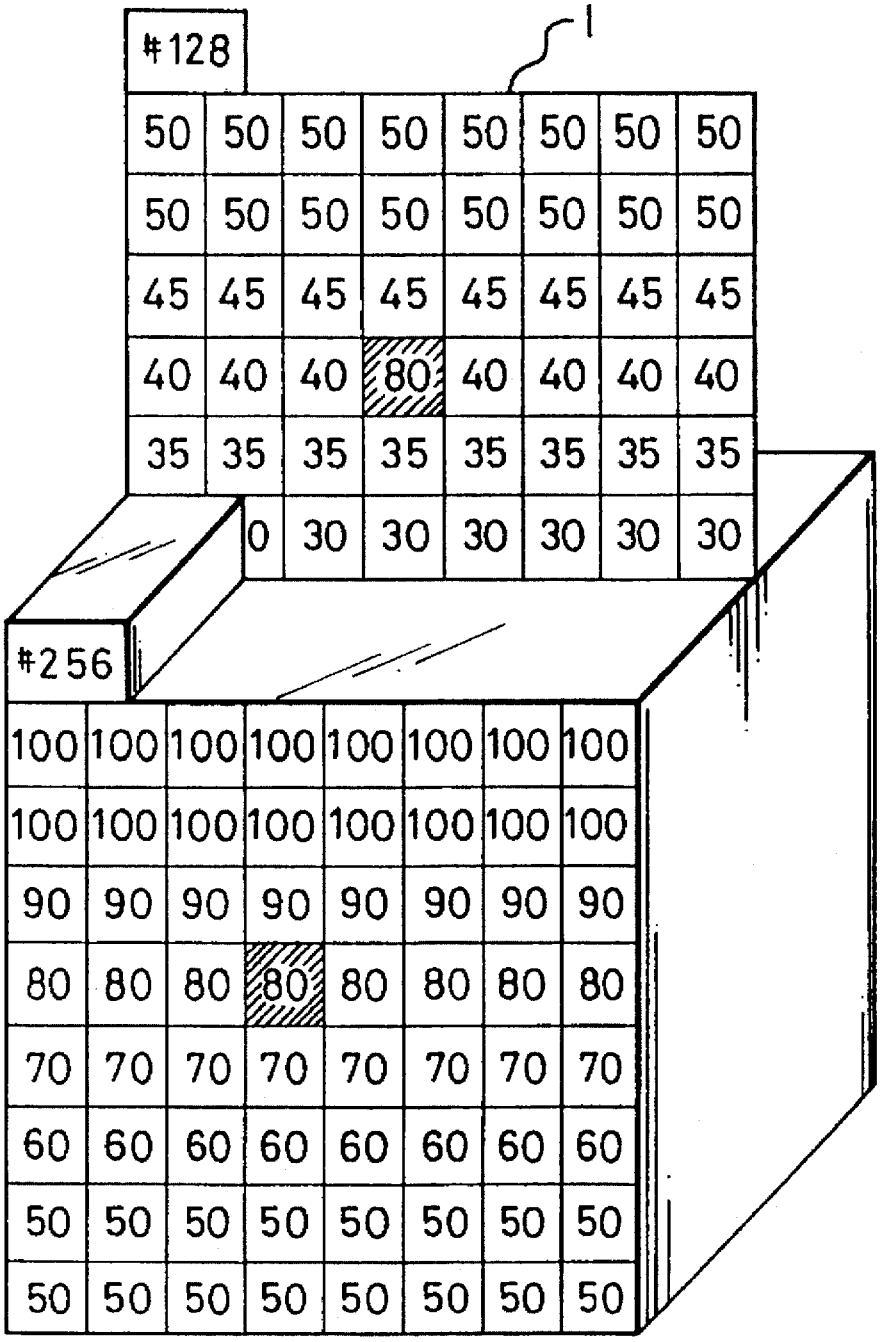
FIG. 4 shows schematically a look-up memory for an image, according to the present invention.

Referring to FIG. 4, the principle of the look-up table 1 shown in FIG. 1 is explained. In a 8×8 matrix capable of displaying a 256 gradation, the look-up table stores data of 8×8×256=16384. Since each data requires a memory size of 8 bit, at least a size of 131072 bit, i.e., about 128 kilobit is at least necessary. In a larger matrix, e.g., such as a one having 640×480 dots which is used generally, a memory size of 1 gigabit must be supplied.

In FIG. 4 is given an example for a one having a 256 gradation. If a brightest state (100) were to be realized, the table must be looked up for a gradient #256. An output of 100 can be obtained on any desired pixel by simply inputting the value corresponding to the desired pixel in the gradient

#256 into the pixel. For example, an output of 100 can be obtained from the pixel at the fourth line in the fourth row by providing 80 as the input.

If one wants to output a brightness at a half (50) the brightness of the case above, the look-up table is searched again for a gradient of #128 and obtain an input of 30 by looking the fourth line at the fourth column. It should be noted here, however, that the correcting process according to the method as shown in FIGS. 1 and 4 corrects the input information irrespective of the non-linear relation of brightness between the input and the output. More specifically, this is in sharp contrast with the processes illustrated in FIGS. 2 and 3, because such processes are effective only for a simple or a univocal processing. Accordingly, when a system comprises both linear pixels and non-linear ones to be processed, the non-linear ones have difficulty in their correction. In such a case, a correction in average should be applied, and hence some non-linear functioning pixels lack correctness. In the look-up table correction system, however, a precise correction can be made as to give a distinct difference between them. The memories for use in the look-up table include RAMs such as DRAM and SRAM, as well as non-volatile memories such as EPROM, EEPROM, and flash memories.

Figure 5:
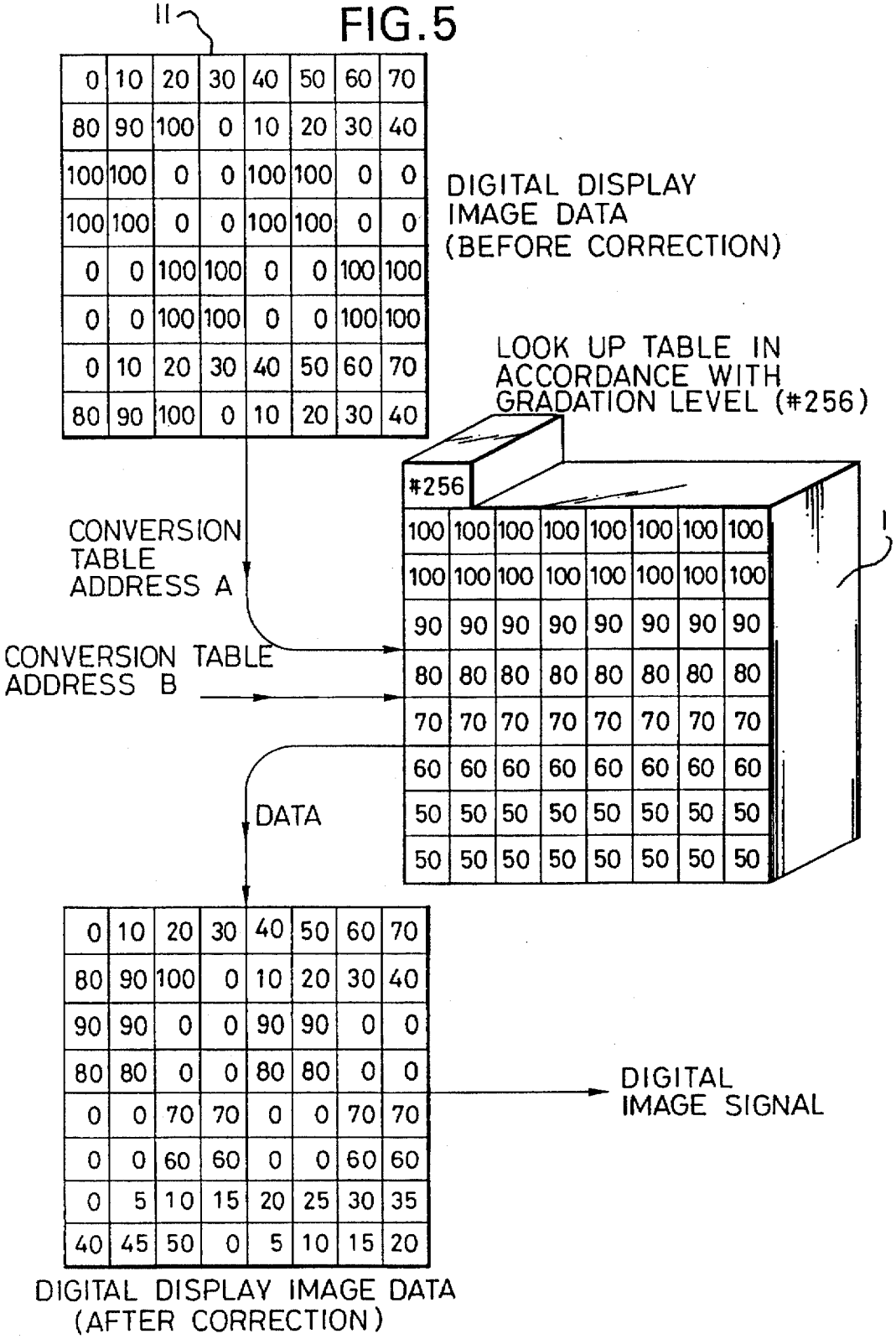
FIG. 5 shows another example of correcting an image data according to the present invention.

Referring to FIG. 5, the flow of a data is explained. The brightness signal 11 before being corrected includes the brightness (gradient), and the synchronizing signal carries the information on the position (address) of the pixel. Accordingly, based on those pieces of information, a properly corrected signal is sent out from the look-up table 1 to be input into the pixel via a circuit as shown in FIG. 6.

In the system according to the present invention, digital signals are input into the pixel. Thus, the gradation display is obtained by applying a digital signal to the system. The system for obtaining a display with gradation, i.e., a "digital gradation system", is explained briefly below.

Figure 7:
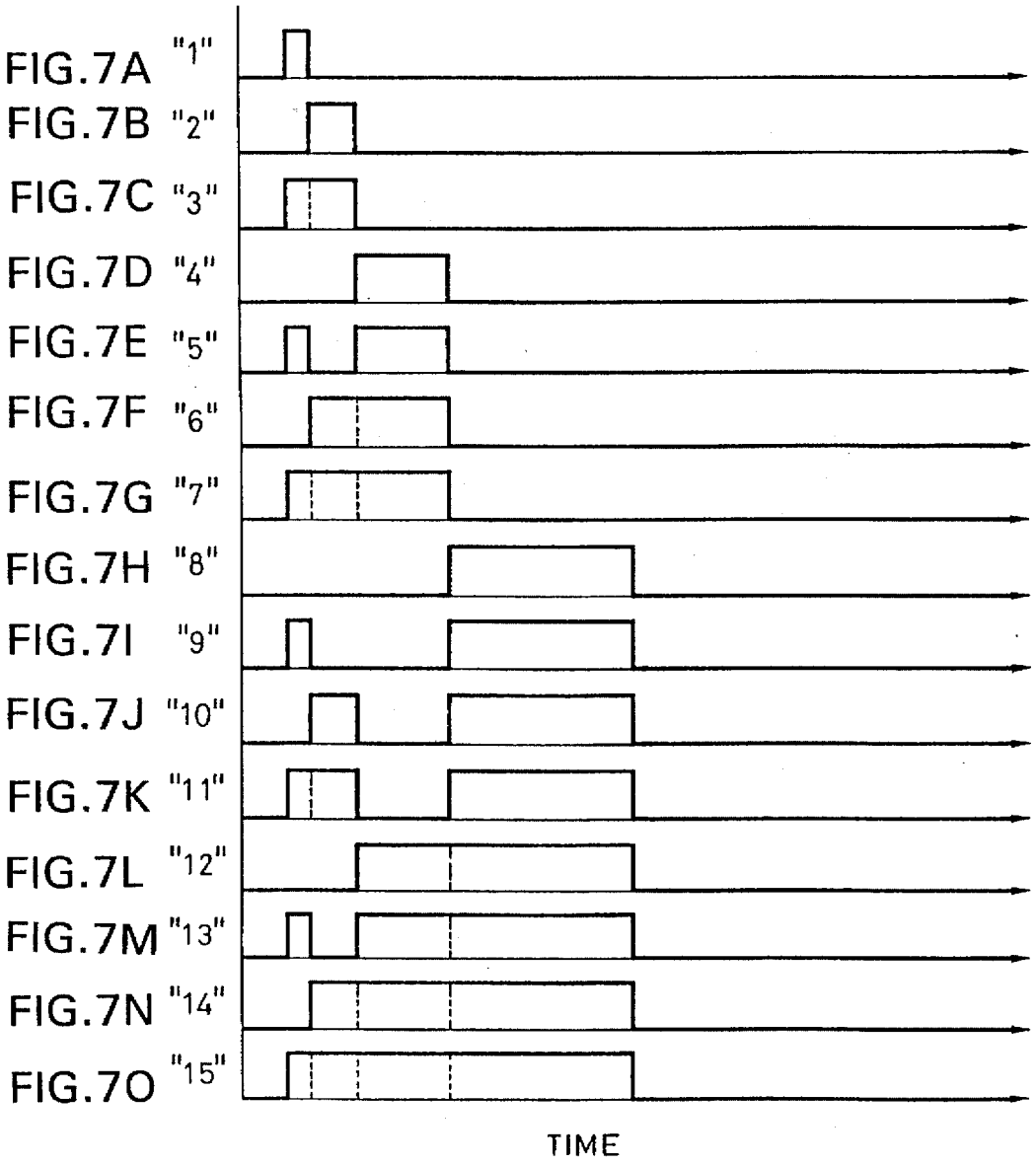
FIG. 7 shows an example of a driving signal according to the present invention.

The digital gradation system is characterized by that the desired gradation is obtained by controlling the duration of applying the voltage to the pixel. For example, in a liquid crystal pixel made of a TN liquid crystal, i.e., a representative liquid crystal material, operating in a normally black mode (a mode which displays black by allowing no light transmittance at a state with no applied voltage), the brightness thereof is varied by applying a voltage having a waveform as shown in FIG. 7. The brightness of the pixel can be controlled stepwise, and is brighter in the order of "1", "2", . . . "15" as indicated in FIG. 7. Thus, in this example in connection with FIG. 7, a 16-gradation display can be achieved. Needless to say, a liquid crystal pixel operating in a normally white mode (transmits light at no applied voltage) is brightest at "1", and darkest at "15".

In FIG. 7, the waveform "1" signifies application of a pulse having a unit length (duration). The waveform "2" stands for a pulse having a length of 2 units. In "3", a pulse at a unit length and that at a length of two units, 3 units in total length, are applied. "4" means application of a pulse at a length of 4 units. "5" represents a waveform consisting of a pulse having a unit length and a pulse at a length of 4 units, whereas "6" represents such consisting of a pulse with a length of 2 units and a pulse of 4 units. Then, by providing additionally a pulse having a length of 8 units, pulses up to a length of 15 units can be obtained as a result.

More specifically, a display with $2^4$=16 gradation can be realized by properly combining four types of pulses, i.e., pulses with a length of 1-, 2-, 4-, and 8-units. Analogously, displays with higher gradation, i.e., 32-, 64-, 128-, and 256-gradation steps can be achieved by providing pulses at a length of 16 units, 32 units, 64 units, and 128 units, respectively. In obtaining a 256-gradation display, for example, 8 types of pulses should be arranged.

In the example described with reference to FIG. 7, the voltage was applied to the pixel in such a manner that the duration of the pulses increase in a geometrical series, i.e., from the initial $T_1$ to $2T_1$, and then to $4T_1$. But the order is not limited thereto, and the pulses may be arranged in such a manner that the first pulse has a duration of $T_1$, the second with $8T_1$, the third one with $2T_1$, and the last with $4T_1$. Such an arrangement reduces load of the devices at the transfer of data to the display device.

Figure 8:
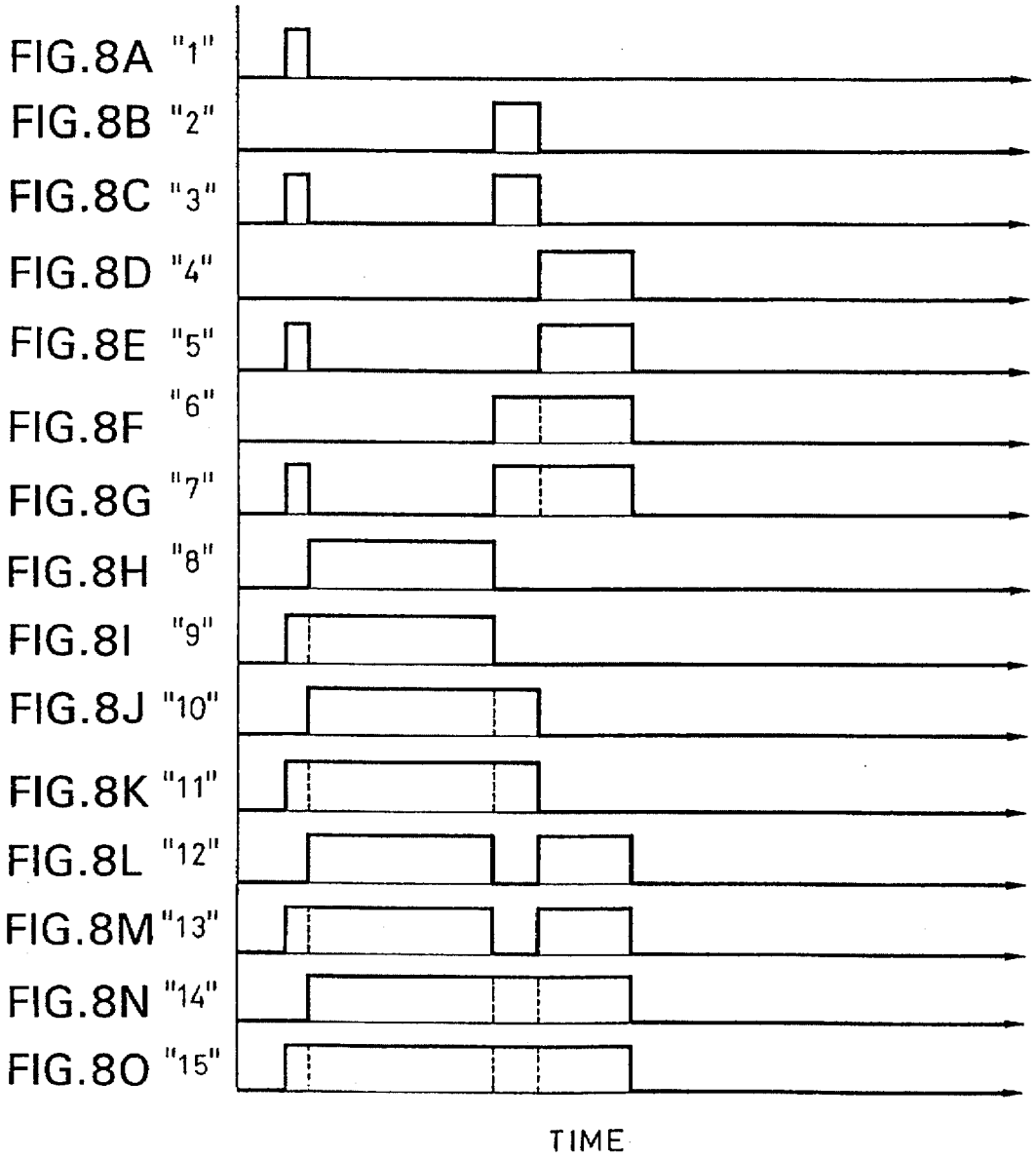
FIG. 8 shows another example of a driving signal according to the present invention.

Thus, FIG. 8 illustrates another example of an arrangement for obtaining sixteen gradation levels. The arrangement of FIG. 8 is advantageous when two adjacent signals are coupled and processed as one unit signal. Thus, for example in the case of FIG. 7, the minimum period of the coupled signals would be $3T_1$ while in the case of FIG. 8, the minimum period of the coupled signals would be $6T_1$ which is longer than $3T_1$ when the above mentioned driving method is employed. Accordingly, the driving circuit for processing the coupled signals can be driven at a slower speed in the case of FIG. 8 as compared with FIG. 7. Thus, the arrangement of FIG. 8 reduces load of the devices at the transfer of data to the display device.

The digital gradation system above can be practiced most preferably by using TN and STN liquid crystals, a ferroelectric liquid crystal, an antiferroelectric liquid crystal, and a dispersion type (polymer) liquid crystal. Despite the pulse width per unit length slightly differs from a liquid crystal material to another, it was found suitable for a TN liquid crystal material to select the pulse width in the range of from 10 nsec to 100 msec.

Figure 10:
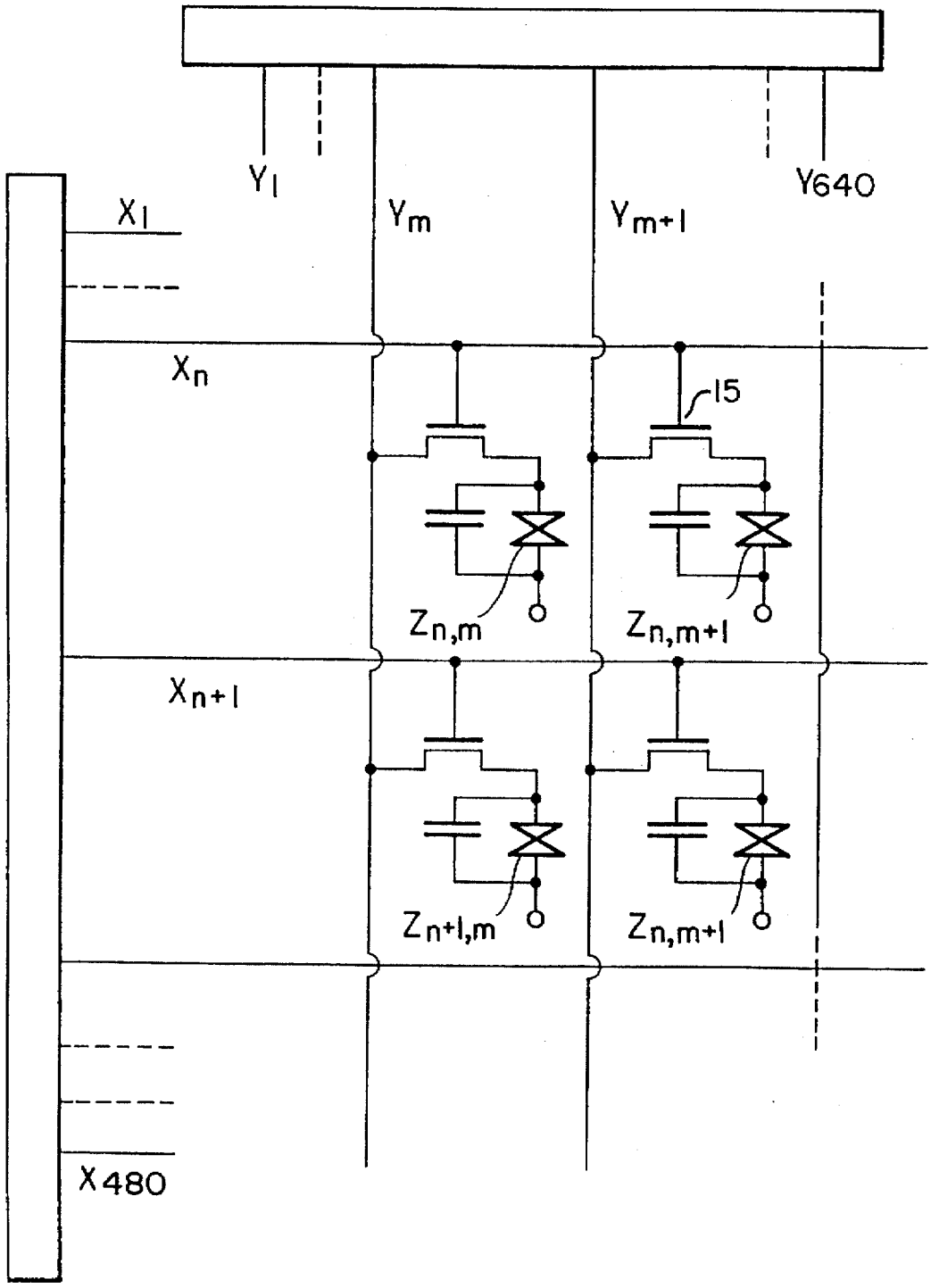
FIG. 10 shows schematically a matrix construction according to the present invention.

The digital gradation system above can be operated, for example, by assembling a matrix circuit using TFTs 15 as shown in FIG. 10. The circuit shown in FIG. 10 is the same as those used in the conventional active-matrix driven display devices using TFTs.

Figure 9:
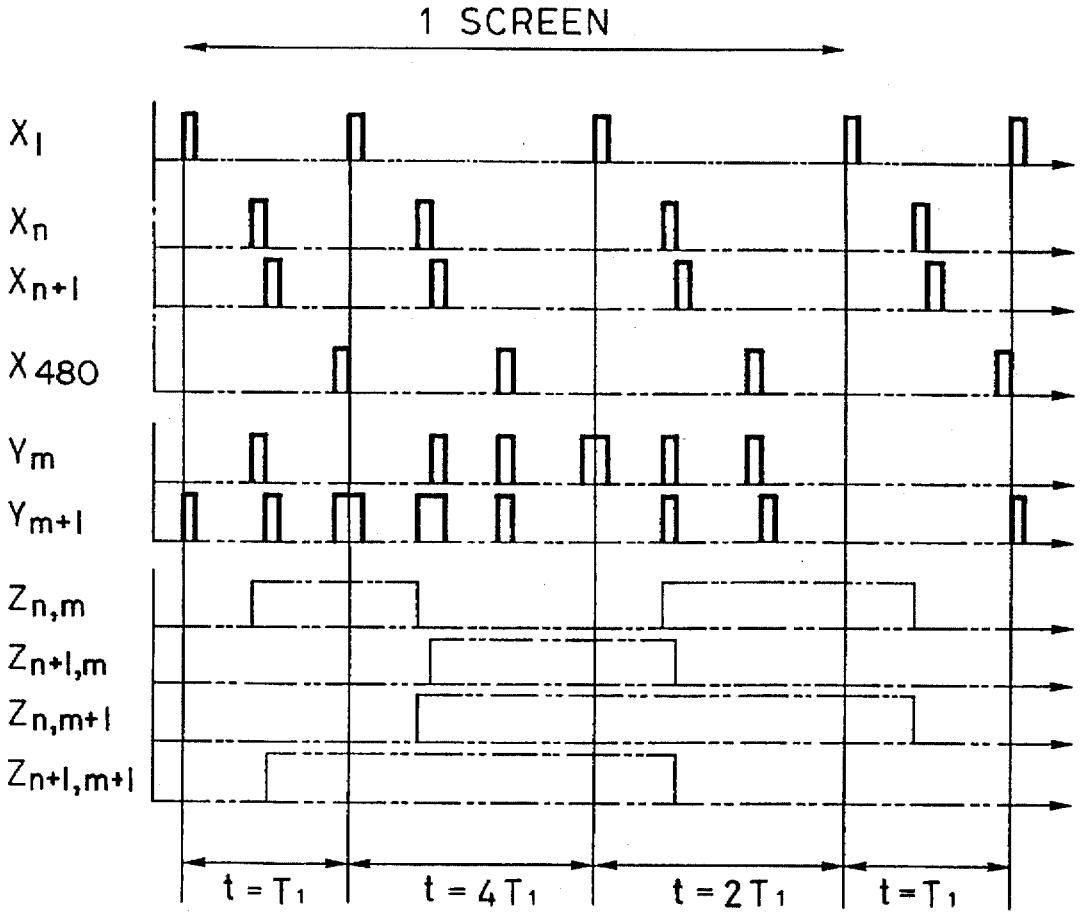
FIG. 9 shows another example of a driving signal according to the present invention.

The voltage applied to the pixel can be turned ON and OFF by controlling the gate voltage or the voltage between the source and the drain of the TFTs 15. In the figure illustrating a matrix of 640×480 dots for this example, only a part including the vicinity of the n th line at m th row is illustrated for the brevity's sake. A complete structure of this type can be readily obtained by extending the same structure along the four directions. The operation of the resulting circuit is shown in FIG. 9.

The signal lines $X_1, X_2, \ldots X_n, X_{n+1}, X_{480}$ (referred to collectively hereinafter as X lines), are each connected to each of the gates of the TFTs. As shown in FIG. 9, rectangular pulse signals are applied sequentially to the signal lines. The signal lines $Y_1, Y_2, \ldots Y_m, Y_{m+1}, Y_{640}$ (referred to collectively hereinafter as Y lines), are each connected to each of the sources (or the drains) of the TFTs, and, as above, signals consisting of a plurality of pulses are applied one after another. The pulse sequence contains 640 pieces of information in a unit length of time, $T_1$.

In the following description, 4 pixels, i.e., $Z_{n,m}$, $Z_{n+1,m}$, $Z_{n,m+1}$, and $Z_{n+1,m+1}$ are considered. Since the voltage of a pixel remains constant unless signals are applied to both of the gate and source at a time, only signal lines $X_n$, $X_{n+1}$, and $Y_m$, $Y_{m+1}$, are taken notice of.

First, suppose a rectangular pulse is applied to $X_n$. Since only the 4 pixels, $Z_{n,m}$, $Z_{n+1,m}$, $Z_{n,m+1}$, and $Z_{n+1,m+1}$, are taken into consideration at the instance, the states of $Y_m$ and $Y_{m+1}$ are to be considered. Because $Y_m$ receives a signal and $Y_{m+1}$ does not, the pixel $Z_{n,m}$ is turned ON and the pixel $Z_{n,m+1}$ remains in an OFF state. By cutting off the pulse in the X line before a voltage applied to the Y line is cut off, the pixel $Z_{n,m}$ maintains the ON state because the high voltage state of the pixel is maintained by the capacitor at the pixel. Then, the pixels basically maintain their states until a signal is applied to $X_n$.

Then, suppose a signal is applied to $X_{n+1}$. As illustrated in the figure, the $Y_m$ in the OFF state and the $Y_{m+1}$ in the ON state turns the pixel $Z_{n+1,m}$ OFF and the pixel $Z_{n+1,m+1}$ ON. The pixels each maintain their states in a manner analogous to above.

When a second pulse is applied to the signal line $X_n$ after a time length of $T_1$ since the application of a first pulse to the $X_n$, the $Y_m$ in the OFF state and the $Y_{m+1}$ in the ON state allow the pixel $Z_{n,m}$ take an OFF state and turn the pixel $Z_{n,m+1}$ ON. A pulse is further applied to $X_{n+1}$. At this point, as shown in the figure, the pixels $Z_{n+1,m}$ and $Z_{n+1,m+1}$ are both in ON states because at that time, the $Y_m$ and the $Y_{m+1}$ are both in ON states. The pixel $Z_{n+1,m+1}$ maintains the ON state.

After time passage of $4T_1$, a third signal is applied to $X_n$. At this time, the pixel $Z_{n,m}$ is turned from the OFF state to an ON state whereas the pixel $Z_{n,m+1}$ remains in the ON state, because both $Y_m$ and $Y_{m+1}$ are in ON states. When a pulse is applied to $X_{n+1}$ thereafter, the pixels $Z_{n+1,m}$ and $Z_{n+1,m+1}$ both are turned OFF because both $Y_m$ and $Y_{m+1}$ are in OFF states. Thus the pixels are no longer in a state applied with a voltage.

A fourth signal is applied to $X_n$ after a time passage of $2T_1$. Since the $Y_m$ and $Y_{m+1}$ are both in OFF states at this point, the pixels $Z_{n,m}$ and $Z_{n,m+1}$ are both turned OFF. A further application of a pulse to $X_{n+1}$ maintains the pixels $Z_{n+1,m}$ and $Z_{n+1,m+1}$ both in the OFF state.

In this manner, the ON/OFF cycle is completed. Three pulses are applied to each of the X lines during this cycle, and 3×480=1440 information signals are applied to each of the Y lines. The total time length for complete cycle is $1T_1+2T_1+4T_1=7T_1$, and $T_1$ preferably has a length in the range of from 10 nsec to 10 msec. Since the pixel $Z_{n,m}$ receives a pulse of length $T_1$ and a pulse of length $2T_1$, the visual effect as a result is the same as the case in which a pulse of length $3T_1$ is applied. That is, a brightness of "3" can be achieved. In a similar manner, the pixels $Z_{n+1,m}$, $Z_{n,m+1}$, and $Z_{n+1,m+1}$ each obtain a brightness of "4", "6", and "5", respectively In the foregoing example, a 8-gradation display is realized. A display with higher gradations can be obtained by applying further pulse signals. For example, by applying 8 pulses in total to each of the X lines and applying 8×480=3840 information signals to each of the Y lines during a cycle (1 picture plane), a gradation as high as 256 gradation steps can be achieved.

The gradation display mentioned hereinabove can be realized by applying ON/OFF signals to the pixels. That is, the digital signals having corrected in the method according to the present invention can be readily applied, either by applying the digital signals as they are or by optimally re-arranging the signals.

As is clearly shown in the foregoing description, a high gradation display requires a fine time sharing. This can be achieved by switching extremely quickly the active elements (TFTs) and the peripheral circuits. More specifically, a moving picture with 256 gradation is only realizable by controlling the $T_1$ in such a manner that $256T_1$ becomes less than 30 msec, i.e., a $T_1$ of less than 100 μsec, because 30 sheets or more pictures are flown per second. Thus, in a system where 480 rows of X lines (connected to the gate), the signal output from each of the Y lines amounts to 480 in a period of 100 μsec. Furthermore, in such a system, the X lines must also follow-up the output speed to drive the TFTs. Accordingly, the TFTs should have a quick response as to cope with the pulses 200 nsec or less in length. In the foregoing example referring to FIG. 10. NMOS TFTs were used alone. However, a higher operation speed can be achieved by connecting the pixels to a circuit comprising CMOS circuits, such as a CMOS inverter circuit, a CMOS modified inverter circuit, a CMOS modified buffer circuit, and a CMOS modified transfer gate circuit.

In the foregoing description, furthermore, no reference was made on a system in which AC is applied. In such a system, the polarity of the voltage applied to the liquid crystal is reversed every picture plane or every several picture planes. Since technological basis thereof is by no means in conflict with the system described above, AC voltage can be applied instead of the DC voltage to avoid degradation of the liquid crystal due to electrolysis and the like which result by applying a DC voltage to the liquid crystal for too long a time.

In the foregoing example, the signals were clearly distinguished by terms "a state with applied voltage (ON state)" and "a state with no applied voltage(OFF state)" to make the explanation simpler. However, the discrimination is based on whether the value is over a threshold voltage or below a threshold voltage, and hence the "state with no applied voltage" need not be strictly zero. It should be also noted that the width and height of the pulses, polarity, and other conditions are subject to the operational conditions of the devices and the like, and that they should be selected appropriately depending to the cases.

Furthermore, the substantial voltage applied to the pixel material can be varied by applying a pertinent bias voltage to the counter electrode of the pixel. For example, voltage may be properly applied to the counter electrode to control the polarity of the voltage applied to the pixel material, and thereby allow the pixel to take both negative and positive polarities. Such a measure is requisite, for example, when a ferroelectric liquid crystal is used.

In the foregoing description, the picture plane was scanned one line after another, but a so-called interlaced scanning may be used as well, by scanning every second line or by skipping a plurality of lines.

The present invention is explained in a further detail referring to non-limiting examples below.

EXAMPLE

Figure 11:
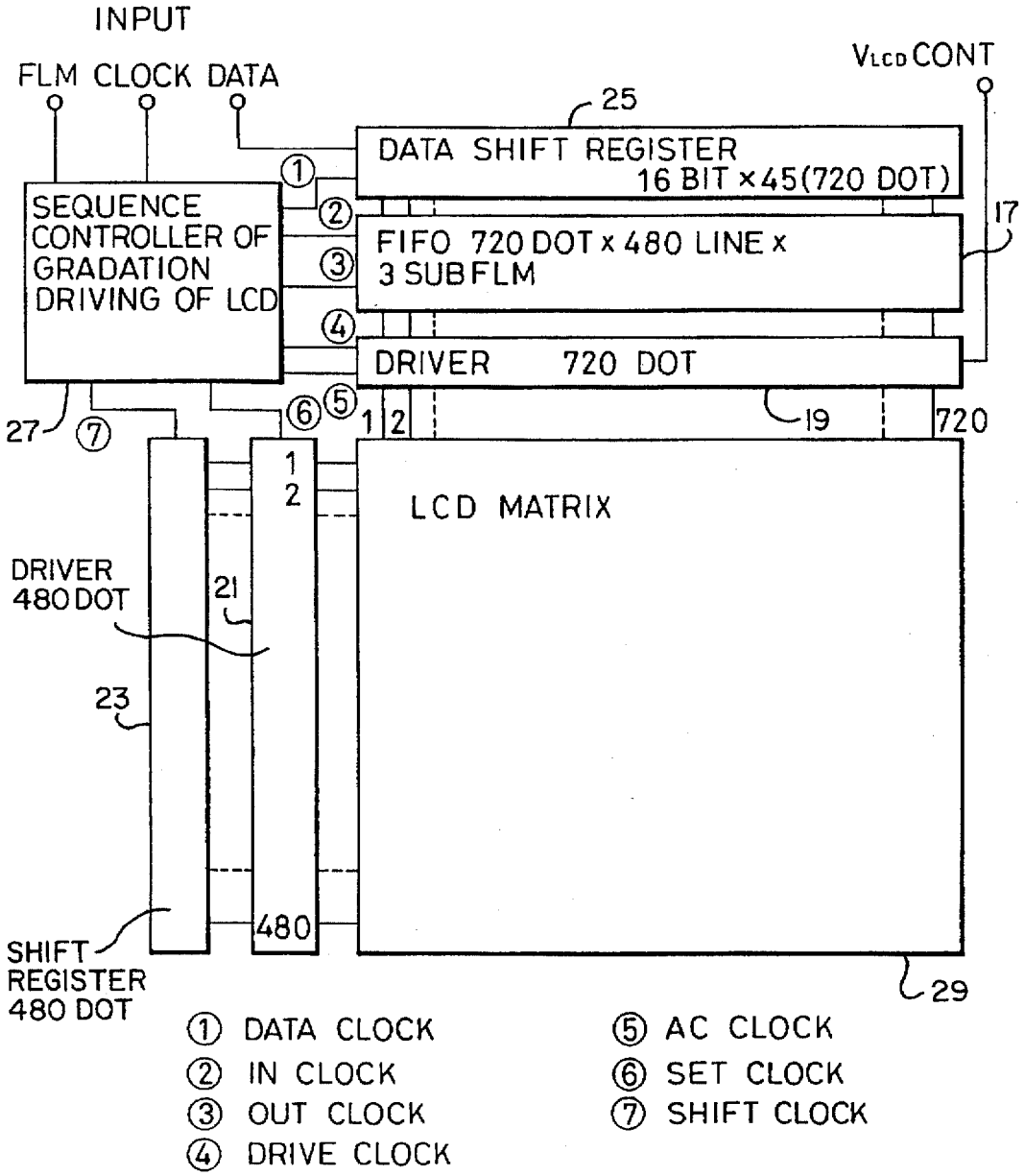
FIG. 11 shows a block diagram for a liquid crystal display device according to an embodiment of the present invention.
Figure 12:
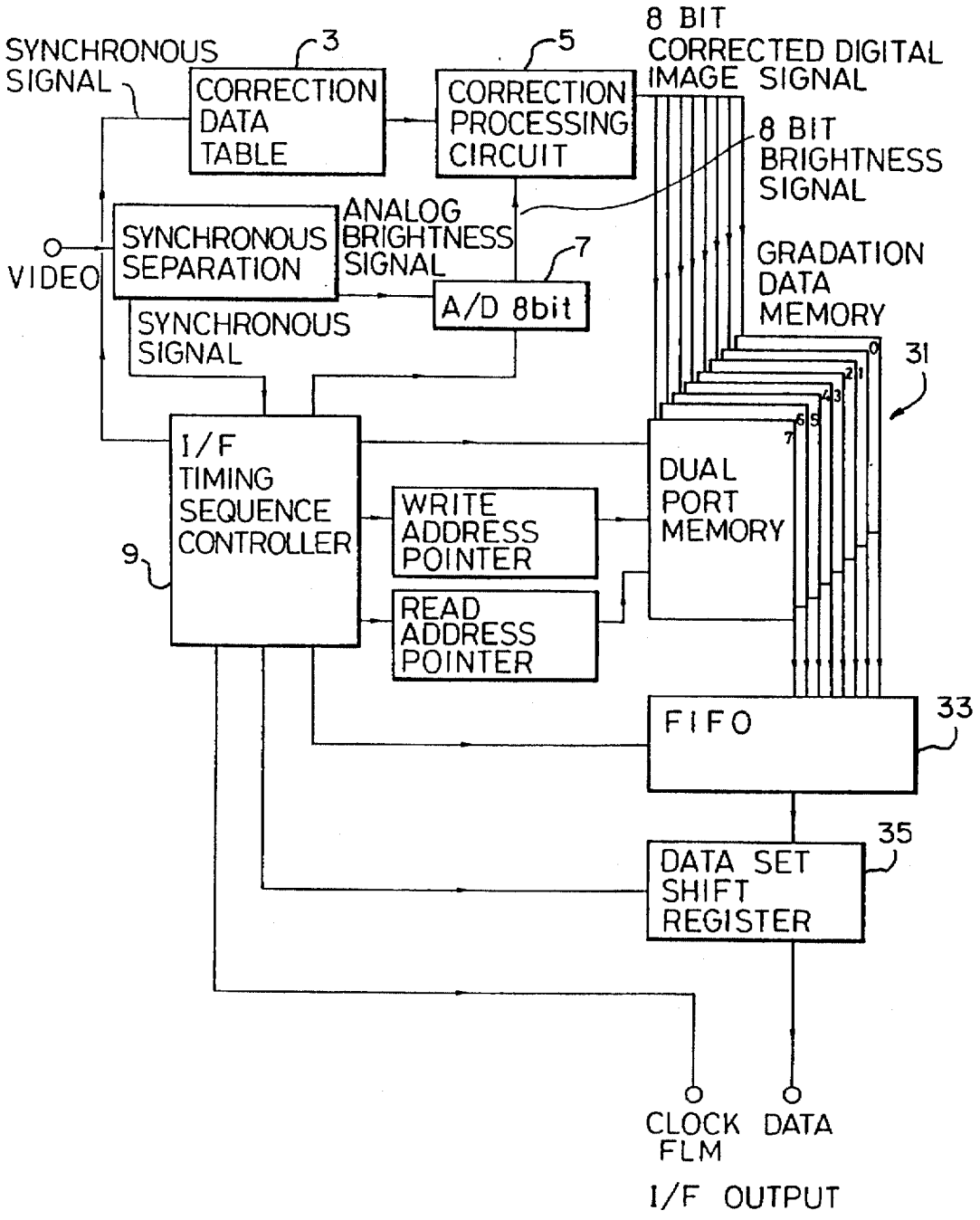
FIG. 12 shows another block diagram for a liquid crystal display device according to another embodiment of the present invention.
Figure 13:
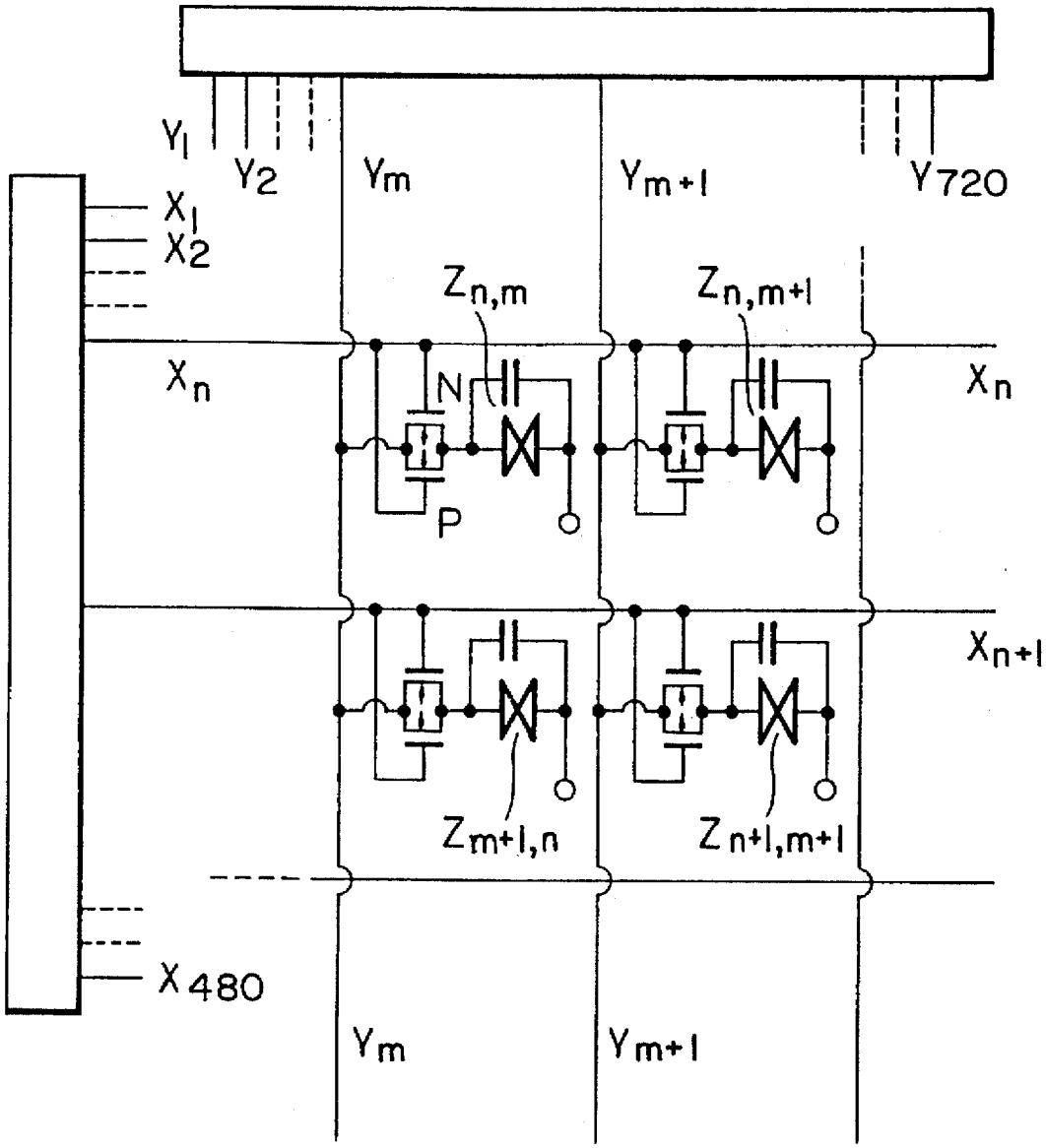
FIG. 13 shows schematically another matrix construction according to the present invention.

Referring to FIGS. 11 to 13, an example of a practical monochromatic television (in NTSC method) driven by the device according to the present invention is explained.

In FIG. 11, a block diagram shows a part of a picture plane and peripheral circuits of a monochromatic television, 720×480 in matrix size. To process the signals at a stable rate, a first in first out (FIFO) memory 17 720×480×3 bit in capacity was provided outside the driver 19 established on the side of the data (Y) line.

The system comprises a 480-dot driver 21 and a 480-dot shift register 23 for the X lines, and a 720-dot driver 19 and a 720-dot shift register 25 for the Y lines. A (16 bit×45)-data shift register was used for the Y lines. The timing of the devices were controlled with a sequence controller of gradation driving of LCD 27.

The matrix (active matrix electro-optical device) of the picture plane was made from a complementary metal oxide semiconductor field-effect transistor (CMOS-FET) transfer gate circuit, using polycrystalline silicon TFTs. In FIG. 13 is given the circuit diagram for the four pixels. This was fabricated by a conventional low-temperature thermal annealing crystallization process well known in the art.

FIG. 12 shows the block diagram of the signal processing portion of the television. The ordinary analog image signals are subjected to synchronizing separation, converted into 8-bit digital image signals using an analog-digital converter 7 (A/D-8 bit converter), and the converted signals are transferred to a correction processing circuit to correct the signals in correspondence with the data stored in the correction data table 3. The correction data table as used herein, having a memory size of 4 megabit, was fabricated from a complete CMOS SRAM to enable rapid processing. The SRAM can be replaced by a non-volatile memory such as an EPROM, an EEPROM, and a flash ROM. The data after processing are stored temporarily in a 720 dot×480 dot×8 bit dual port memory 31 and then transferred to a FIFO memory 33 (different from the FIFOs provided in the periphery of the matrix) in the next step. The dual port memory above functions as a data memory for the gradation display for use in the next step. The data having transferred from the FIFO memory is then output at the data input terminal in FIG. 11 via a data set shift register 35. The peripherals were constructed from monolithic ICs, and the driver terminals were connected to the X- and Y-lines by tape automated bonding (TAB) process well known in the art.

The structure above may be modified, however, by fabricating the peripheral circuits of the matrix, i.e., the drivers, the FIFOs, and the shift registers in particular, simultaneously with the matrix using polycrystalline silicon. The product yield can be improved and the production cost lowered by adopting such a process, because the connection of the X- and Y-lines, which amount to a large number, can be omitted.

As described in the foregoing, a liquid crystal television was fabricated. In this device, the basic signals were input as they are to measure the characteristics of each of the pixels, and the results were written in the correction data table. Then, the image signals were input thereafter to obtain a 256-gradation monochromatic projected image considerably reduced in density unevenness and defects.

The device according to the present invention is characterized by that the gradation display is achieved digitally and not by a conventional analog system. The surprising effect the present invention provides is that, in a liquid crystal electro-optical device having 640×400 dot pixels, for example, a high gradation display of 256 gradation or more can be achieved. Considering that it is extremely difficult to fabricate 256,000 TFTs uniformly and free from any fluctuations in device characteristics, and from the viewpoint of mass productivity and yield, the practically achievable gradation in such a display was believed to be 16 gradation at best. However, the present invention displays the gradation with digital signals alone without incorporating any analog signals, and, moreover, the input digital signals are corrected in accordance with the data having stored for each of the pixels. Thus, a considerably uniform gradation display was realized despite of the fluctuation in the device characteristics of the TFTs. In a conventional process, the product yield of a display was extremely low due to the effort placed for obtaining TFTs with small fluctuation in characteristics; in the process according to the present invention, the TFTs are corrected individually for their fluctuations at a high precision, and hence the production cost can be greatly reduced.

The technological concept of the present invention was explained in detail referring mainly on an electro-optical device, particularly a display device using liquid crystal. However, the concept of the present invention is not only applicable for a display device of a direct vision type, but is also applicable to a projection-type television and to optical switches as well as optical shutters. Furthermore, the electro-optical material need not be a liquid crystal, and other materials which exhibit change in optical properties upon application of an electric effect, e.g., an electric field and voltage, are applicable as well. Concerning the operational mode of the liquid crystal, the liquid crystal need not only be operated on the modes mentioned above but also on, e.g., a guest-host mode.

While the invention has been described in detail and with reference to specific embodiments thereof, it will be apparent to one skilled in the art that various changes and modifications can be made therein without departing from the spirit and scope thereof.

What is claimed is:

1. A method of driving a liquid crystal electro-optical display device comprising the steps of:

multiplying digital original data by digital amendment data which are dependent on addresses of pixels of said liquid crystal electro-optical display device in order to compensate for variation of electric characteristics of said pixels; and sending the products of said digital original data and said digital amendment data to said pixels to drive said pixels.

2. The method of claim 1 further comprising the step of converting original image data into said digital original data.

3. The method of claim 1 wherein said digital amendment data are stored in a memory device selected from the group consisting of RAM, EPROM, EEPROM and flash memory.

4. The method of claim 1 wherein said products are signals of ON and OFF levels.

5. The method of claim 1 wherein each of said products is the product of corresponding one of said digital original data and corresponding one of said digital amendment data.

6. A method of driving an electro-optical device comprising the steps of:

accessing a storage region in a memory in accordance with an address of a pixel of an electro-optical display device and an information of an original data; and sending digital data stored in the accessed storage region to said pixel in accordance with said address to drive said pixel, wherein said digital data are dependent on said address of said pixel and the information of said original data.

7. The method of claim 6 wherein said digital data are determined in order to compensate for dispersion of electric characteristics of said pixels.

8. The method of claim 6 wherein said memory comprises a memory device selected from the group consisting of RAM, EPROM, EEPROM and flash memory.

9. The method of claim 6 wherein said digital data are signals of ON and OFF levels.

10. The method of claim 6 wherein said information contains gradation level of said original data.

11. An electro-optical device comprising:

an active matrix liquid crystal electro-optical device;

a memory device comprising storage regions each of which stores data therein;

a device for converting an analog image signal into a digital image signal; and an arithmetic unit for amending said digital image signal in accordance with the data stored in said storage regions to compensate for different responses of pixels of said electro-optical device with respect to a predetermined voltage being applied to each of said pixels.

12. The device of claim 11 wherein said memory device is non-volatile memory device.

13. The device of claim 11 wherein said data are determined in order to compensate for dispersion of electric characteristics of pixels of said active matrix electro-optical device.

14. The device of claim 11 wherein said converting device comprises an analog-digital converter.

15. The device of claim 11 wherein said data are dependent on addresses of pixels of said active matrix electro-optical device.

16. An electro-optical device comprising:

an active matrix electro-optical device;

a look up table memory device; and a device for converting an analog image signal into a digital image signal;

wherein said look up table memory device comprises storage regions each of which stores data in accordance with an address of a pixel of said active matrix electro-optical device and a gradation level.

17. The device of claim 16 wherein said look up table memory device is non-volatile memory device.

18. The device of claim 16 wherein said converting device comprises an analog-digital converter.

19. The device of claim 16 wherein said look up table memory device comprises storage regions each of which stores data in accordance with an address of a pixel of said active matrix electro-optical device and a gradation level.

20. The device of claim 19 wherein said data are determined in order to compensate for variation of electric characteristics of pixels of said active matrix electro-optical device.

* * * * *